United States Patent [19]

Heusler et al.

[11] 3,945,138

[45] Mar. 23, 1976

[54] HYDRAULICALLY CONTROLLED AND DRIVEN BUCKET WHEEL DREDGE

[75] Inventors: Helmut Heusler, Dortmund-Kirchhorde; Günther Alpers, Dortmund-Kirchlinde; Jürgen Gerber, Ergste, all of Germany

[73] Assignee: Orenstein & Koppel Aktiengesellschaft, Berlin, Germany

[22] Filed: Mar. 27, 1975

[21] Appl. No.: 562,545

Related U.S. Application Data

[63] Continuation-in-part of Ser. No. 371,135, June 18, 1973, abandoned.

[30] Foreign Application Priority Data

June 16, 1972 Germany ..... 2229347

[52] U.S. Cl. ..... 37/190; 37/DIG. 1; 91/412; 173/8; 299/1

[51] Int. Cl.[2] ..... E02F 3/88

[58] Field of Search ..... 37/189, 190, 64–67, 37/DIG. 1; 173/8, 9; 299/1, 71, 74–78; 91/412; 60/421

[56] References Cited

UNITED STATES PATENTS

| | | | |
|---|---|---|---|
| 3,189,103 | 6/1965 | Attebo et al. | 173/8 |
| 3,380,179 | 4/1968 | Schmidt | 37/67 X |
| 3,470,635 | 10/1969 | Langwer et al. | 299/1 X |
| 3,471,949 | 10/1969 | Cargile, Jr. | 37/64 |
| 3,548,570 | 12/1970 | Unott et al. | 37/189 X |

FOREIGN PATENTS OR APPLICATIONS

| | | | |
|---|---|---|---|
| 1,188,891 | 7/1966 | Germany | 37/117.5 |

*Primary Examiner*—E. H. Eickholt
*Attorney, Agent, or Firm*—Walter Becker

[57] ABSTRACT

A hydraulically controlled and driven dredge, in which the pumps for delivering the driving fluid for the bucket wheel drive are equipped with output controls for controlling the fluid delivery in conformity with the encountered digging resistance and that a control conduit branched off from a pressure conduit leading to a hydraulic motor for driving the bucket wheel is connected to an output limiting valve located in a control circuit which includes an adjusting device connected through conduits to a manually operable control for varying the delivery and the delivery direction of the pump for actuating the hydraulic motor for pivoting the upper structure of the dredge. The fluid delivery of the pumps to the hydraulic motor employed for driving the track laying mechanism being conveyed to the hydraulic motor for driving the bucket wheel when the track laying mechanism is not to be operated.

6 Claims, 10 Drawing Figures

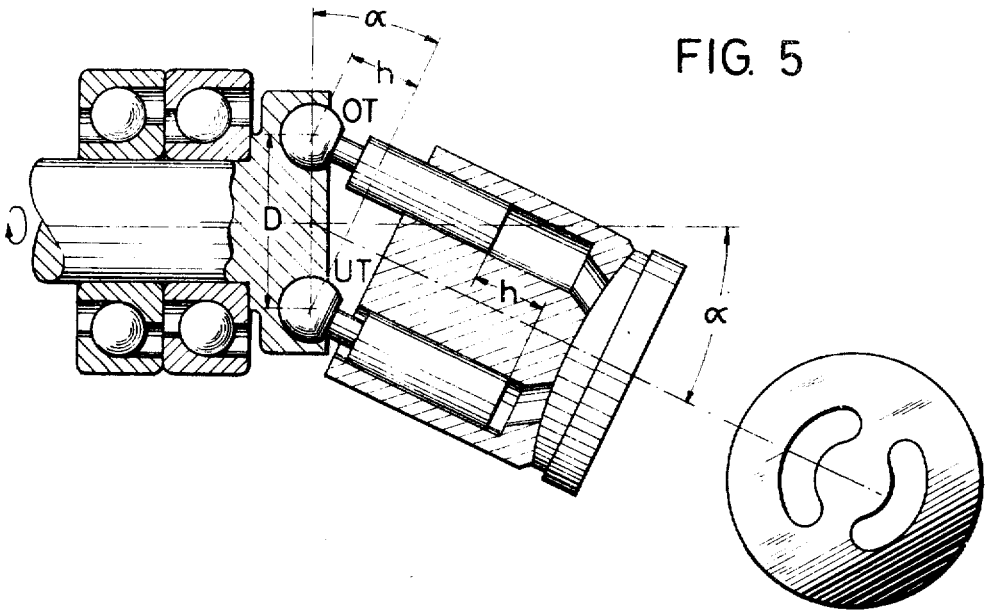
FIG. 5
FIG. 6
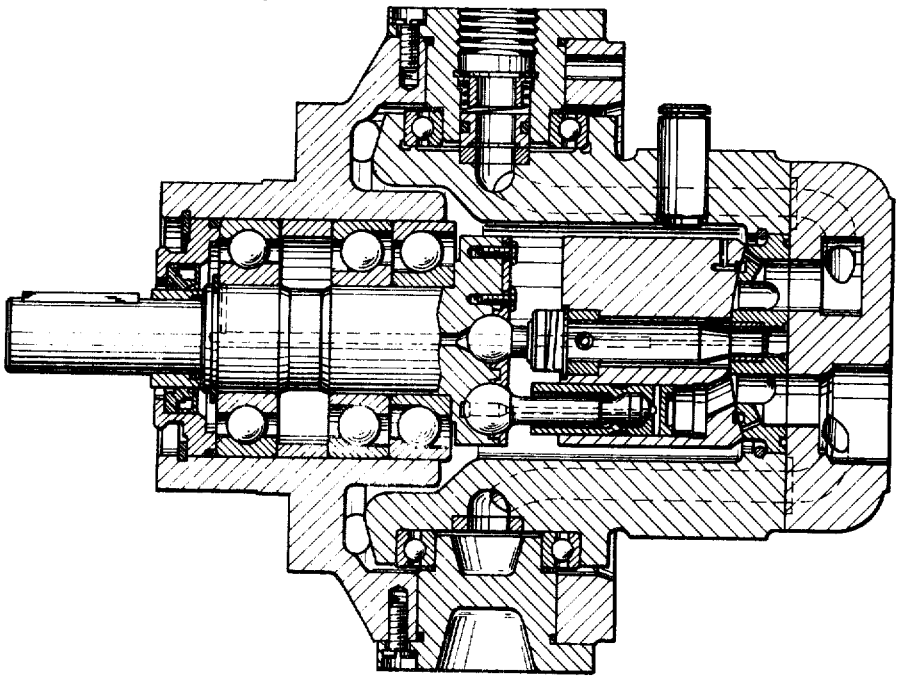

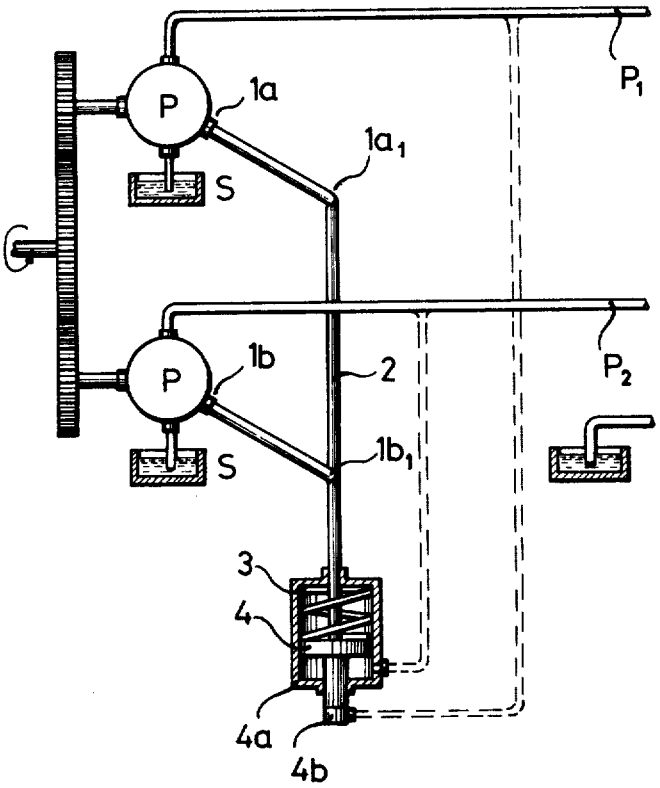
FIG. 7
FIG. 8
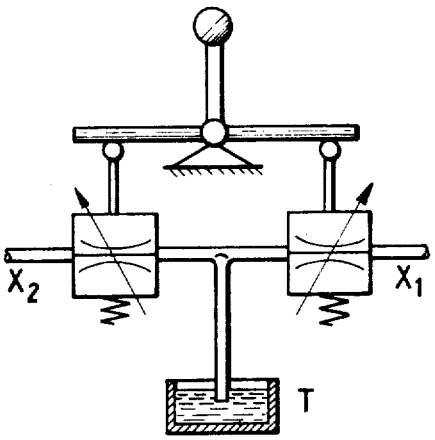
FIG. 9
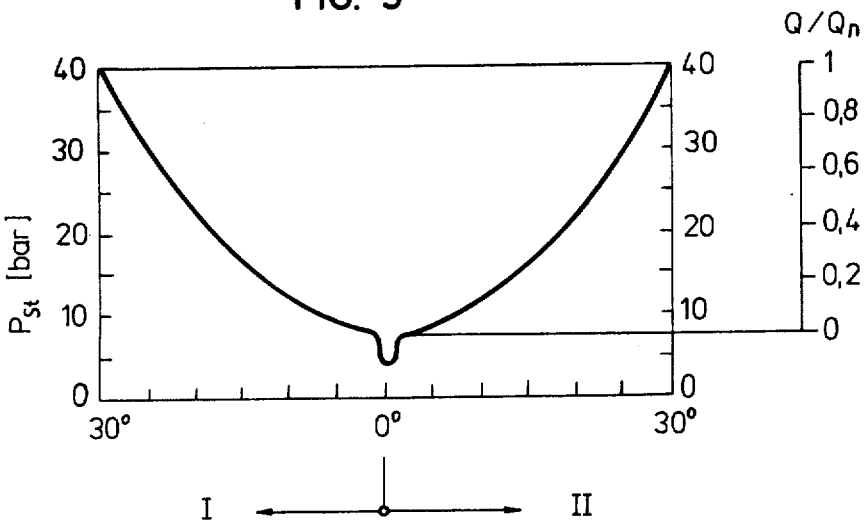

HYDRAULICALLY CONTROLLED AND DRIVEN BUCKET WHEEL DREDGE

This is a continuation-in-part of co-pending application Ser. No. 371,135-Heusler et al filed June 18, 1973 (Monday) and now abandoned.

The present invention relates to a hydraulically controlled and driven bucket wheel dredge with hydraulic circuits comprising adjusting pumps and hydraulic motors for the bucket wheel drive and for the drive for pivoting the bucket wheel boom and with hydraulically driven tracks in which each track chain has a hydraulic circuit of its own.

With a heretofore known bucket wheel dredge, the pivoting speed of the upper structure of the dredge and thereby of the bucket wheel boom is controlled electrically by making effective various resistance stages in conformity with the pivot angle of the bucket wheel boom in such a way that the pivoting speed increases in conformity with the chip depth when laterally pivoting during block operation. Aside from the fact that with this control arrangement the condition of the soil is not taken into consideration so that a uniform power absorption is not assured, with the heretofore known implement expensive drive and control elements are employed which are liable to disorders.

According to a further heretofore known bucket wheel dredge, an electric control is provided by means of which the pivoting speed depends not only on the chip depth decreasing during the pivoting operation but also depends on the conveying output. Such an electric control requires an electric drive of the entire implement. In view of the necessary control possibility, a Leonard-unit is required for transforming the high voltage polyphase alternating current into direct current. Such an electric drive is expensive and liable to disorders. Moreover, suddenly occurring changes in the condition of the soil and in particular obstacles, for instance, in the form of large rocks can with the described arrangement not be coped with at all or only when the operator pays additional attention.

It is, therefore, an object of the present invention to provide a hydraulically controlled and driven bucket wheel dredge which will overcome the above mentioned drawbacks and which will be able at lower construction costs and with reduced chance of disorders to control the operation of a bucket wheel dredge independently of the operator in such a way that also with varying digging resistance a substantially uniform digging output will be realized.

It is a further object of this invention to provide a bucket wheel dredge as set forth in the preceding paragraph, which even when encountering solid soil enclosures, as for instance large rocks, will prevent a jamming and damaging of parts of the bucket wheel dredge.

These and other objects and advantages of the invention will appear more clearly from the following specification in connection with the accompanying drawings, in which:

FIG. 1 diagrammatically illustrates a side view of a bucket wheel dredge equipped with a hydraulic control according to the invention.

FIG. 5 is a schematic illustration of the drive mechanism (pump).

FIG. 6 provides a constructive illustration of the pump.

FIG. 7 illustrates mechanical interconnection of double pump means and mechanical linkages therewith.

FIG. 8 represents schematically construction of a control device.

FIG. 9 represents the control characteristic thereof.

Figure 10:
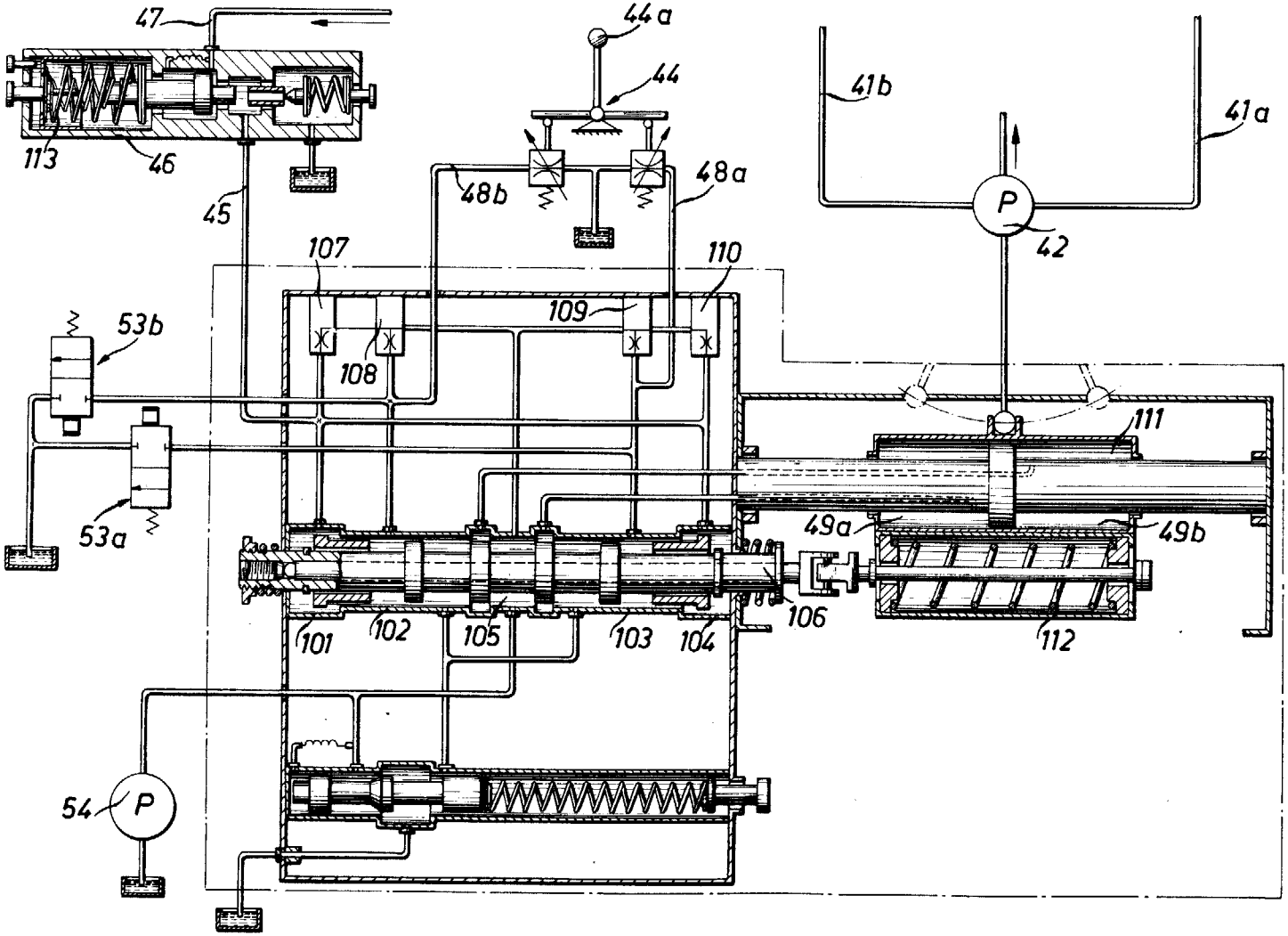

FIG. 10 represents cooperation of elements 44 and 43 in a schematic diagrammatic illustration.

The bucket wheel dredge according to the present invention is characterized primarily in that the pumps for the bucket wheel drive are provided with output governors which are influenced by the digging resistance of the bucket wheel and control the delivery quantity. The dredge according to the present invention is furthermore characterized in that a control conduit branching off from a pressure conduit which leads to the hydraulic motor for driving the bucket wheel is in communication with an output limiting valve. This output limiting valve is arranged in a control circuit which comprises a control device which is operable for controlling the quantity of the delivery and for changing the direction of the delivery and which through conduits communicates with a manually operable control and which pertains to a pump operating in a closed circuit for actuating the hydraulic motor for pivoting the upper structure. The dredge according to the invention is also characterized in that the delivery currents of the pumps employed for moving the dredge are conveyed through conduits to the hydraulic motor for the bucket wheel drive when the hydraulic motors for the track laying drive are not actuated.

In a further embodiment of the invention there is provided a manually operable control device 44 in place of a hand lever 44*a*, and the same becomes controlled by way of a cam disc means 44*b* which more or less strongly presses down two cams 44*c* and 44*d* projecting out of the manually operable control device 44; the control occurs corresponding to the pivot angle of the boom carrying the scoop or blade wheel.

Figure 1:
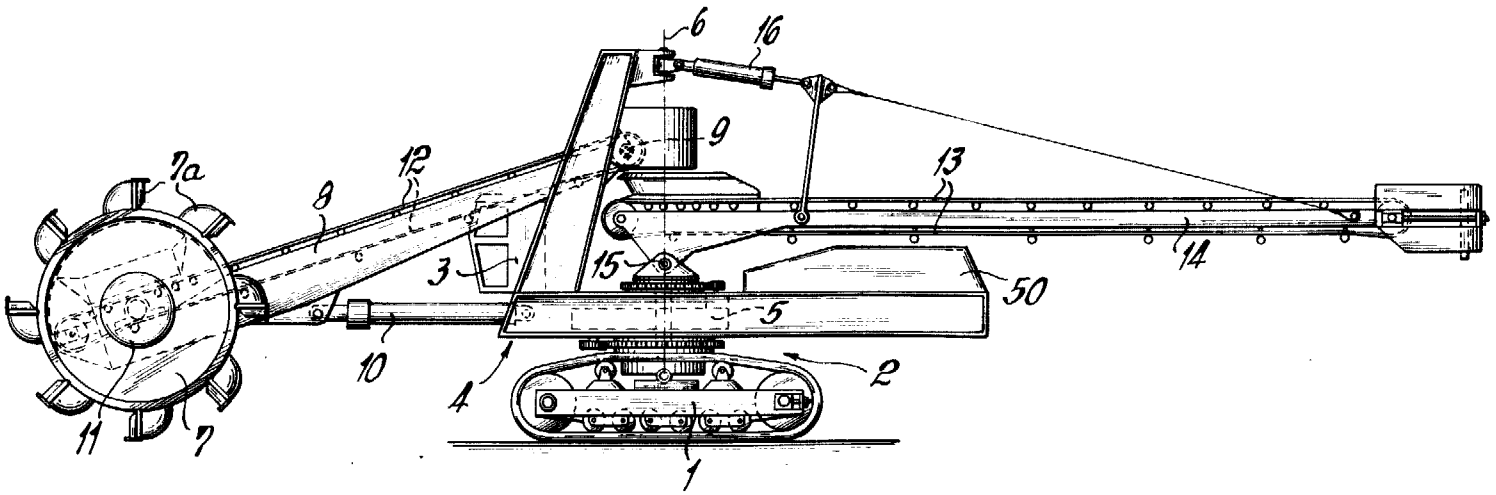

Referring now to the drawings in detail, the bucket wheel dredge shown in FIG. 1 comprises an understructure 2 which is movable on track laying means 1. Pivotally mounted on the understructure 2 is the upper structure 4 which supports the operator's stand or cab 3. The upper structure 4 is by means of a hydraulic rotary or turning drive 5 pivotable about a vertical axis 6. The bucket wheel boom 8 which carries the bucket wheel 7 provided with buckets 7*a* has its rear end journalled in bearings 9 for pivoting in a vertical plane, the pivot bearing 9 being mounted on the upper structure 4. This pivoting in a vertical plane is effected by means of the hydraulic cylinder piston system 10. The drive of the bucket wheel 7 is effected by means of a hydraulic rotary or turning drive 11. Mounted on the bucket wheel boom 8 is a conveyor belt 12 for withdrawing the dredged material. From the conveyor belt 12 the dredged material is conveyed to the conveyor belt 13 which is mounted on the discharge boom 14 which latter is pivotable about the axis 6 relative to the upper structure 4 in a horizontal plane and is also pivotable vertically by means of a hydraulic cylinder piston system 16 about the pivot point 15.

The hydraulic motor 20 pertaining to the hydraulic rotary drive 11 of the bucket wheel 7 is through conduits 24–27 and 29*c* and through the control valves 28*a* and 28*b* for supplying the hydraulic motors 30*a* and 30*b* and through conduits 29*a* and 29*b* in communication with the double pumps 21 and 22. The turning-on and turning-off of the hydraulic motor 20 and the control of the pressure thereof are effected by means of the servo-valve controlled pressure limiting valve 34 with pressure relief through the two-way valve 23. The hydraulic motors 30*a* and 30*b* which are employed for driving the vehicle may, when desired, through conduits 31*a* –31*d*, control valves 28*a* and 28*b* (6/3-way or spool valves) and conduits 26 and 27 be connected to the pumps 21*b* and 22*b*. The deliveries of the pumps 21*a*, 21*b*; 22*a*, 22*b* are in conformity with the produced pressure controlled from zero to the maximum pressure by the total output control devices 32, 33 pertaining to these pumps.

The adjustment of pump 42 is effected by the control unit 43 which is associated with pump 42 and which operates in conformity with the principle of the pressure-sequence-control. In its zero position, the pump 42 is controlled by centering springs 49*a* and 49*b*. The adjusting unit or control unit 43 is in communication with the source of pressure fluid 54 through conduits 48*a* and 48*b*, the manually operable control device 44 which varies the pressure in the control conduits 48*a* and 48*b* and through conduit 45. Independently of the manually operable control device 44, the control pressure conveyed through conduit 45 may be varied by means of the output limiting valve 46 which is adjustable in conformity with the pressure prevailing in the conduit 29*c*, this pressure being conveyed to the output limiting valve 46 through the connecting conduit 47.

Operation

It may be assumed that the speed of rotation of the driving machine 50 and thereby the speed of the pumps 21, 21*b*, 22, 22*b* and 42 connected through the transmission 51 with the driving machine 50 is constant. As long as the operator does not wish to drive the bucket wheel 7, the two-way valve 23 of the servo-motor equipped pressure limiting valve 34 is in its control position I. In this position, the conduits 24–27 are through the valve 34 connected to the tank 52 is a pressureless condition. For moving the implement, the control valves 28*a* and 28*b* have to be moved out of their neutral position, depending on the desired driving direction. In this connection, the pressure oil delivered by the pumps 21*b*, 22*b* through conduits 26, 27 is after selected control position conveyed to the conduits 31*a*–31*c*. At the same time the supply to the conduits 29*a* and 29*b* is blocked. If it is desired to turn the bucket wheel 7 or to actuate its hydraulic motor 20, it is necessary to move the two-way valve 23 of the pressure-limiting valve 34 to the control position II. In this way the pressureless rotation of the double pumps 21 and 22 is blocked, and the pressure oil delivered by the pumps 21*a*, 21*b*, 22*a* and 22*b* passes through the common conduit 29*c* to the hydraulic motor 20 and, after performing the required work, passes in a pressureless manner to the tank 52. If, in view of an increased digging resistance the oil pressure increases in conduit 29*c*, the total output controls 32 and 33 which through conduits 32*a*, 32*b* and 33*a*, 33*b* communicate with this pressure will reduce the delivery quantities of the double pumps 21 and 22.

The hydraulic motor 40 serving for pivoting the upper structure 4 is in communication with the pump 42 in a closed circuit through conduits 41a and 41b. The direction of delivery of pump 42 is reversible. When the manual control 44 occupies its neutral position, pump 42 will likewise occupy its neutral position which means that no pressure oil is conveyed in the conduits 41*a* and 41*b*. If now the operator moves the hand lever 44a of the manual control 44 from its neutral position by a turning movement toward the right or toward the left, the control oil oncoming through the conduit 45 from the pressure source 54 will, depending on the position of the hand lever 44*a*, pass either through the conduit 48*a* or through the conduit 48*b* to the adjusting unit 43. The control pressure prevailing in the conduit 48*a* or 48*b* is proportional to the shifting stroke of the hand lever 44*a* on the manual control 44. Consequently, also only a proportional movement of the adjusting unit 43 relative to the springs 49*a* and 49*b* occurs. In the bypass of the control conduit 45 there is provided an output limiting valve 46. This valve is through a control conduit 47 in communication with the conduit 29*c* leading to the hydraulic motor 20. Inasmuch as the resistance at the digging edges of the buckets 7*a* and thereby, in view of the output control of pumps 21 and 22, the speed of the bucket wheel 7 or the pouring speed is strongly dependent on the feeding speed, i.e. on the pivoting speed of the upper structure 4, a control of the pivoting speed in conformity with the digging resistance is expedient. This can be realized in conformity with the present invention by the pressure prevailing in conduit 29*c* bringing about an adjustment of the pressure setting valve of the output limiting valve 46 through conduit 47. When the speed of rotation of the bucket wheel 7 and thereby the pouring speed decreases, the control pressure conveyed through the control conduit 45 will be reduced in proportion thereto in the output limiting valve 46. Thus, a superposition of the control of the control pressure effective from the pressure fluid source 54 to the adjusting unit 43 occurs relative to the manual control 44. If the operator has shifted the lever 44a of the manual control 44 to its full extent, or in other words, if the pump 42 has been shifted to maximum delivery position, the reduction in pressure in the output limiting valve 46 brings about a return shifting of pump 42; this brings about a reduction in the delivery, which in turn means a reduction of the speed of rotation of the hydraulic motor 40.

To prevent that due to carelessness of the operator, the bucket wheel boom 8 which carries the bucket wheel 7 will collide withh the dredge boom 14 carrying the charging belt 13, the control outputs 48*a* and 48*b* may, by means of the limit switch (55 in FIG. 4) and the magnetic valves 53*a*, 53*b*, be made pressureless. This means a return shifting of pump 42 to its neutral position, in other words, an interruption of the pivoting operation. A moving out of this critical position is possible at any time by an opposite actuation of the hand lever 44*a*. Alternately, cam means 44*b*, 44*c* and 44*d* of FIG. 3 can be used for this purpose. There can be seen that two cams 44*c* and 44*d* are brought forth out of the manual control emitter, and these cams are pressed more or less strongly between cam 44*b* according to engagement involved.

Figure 4:
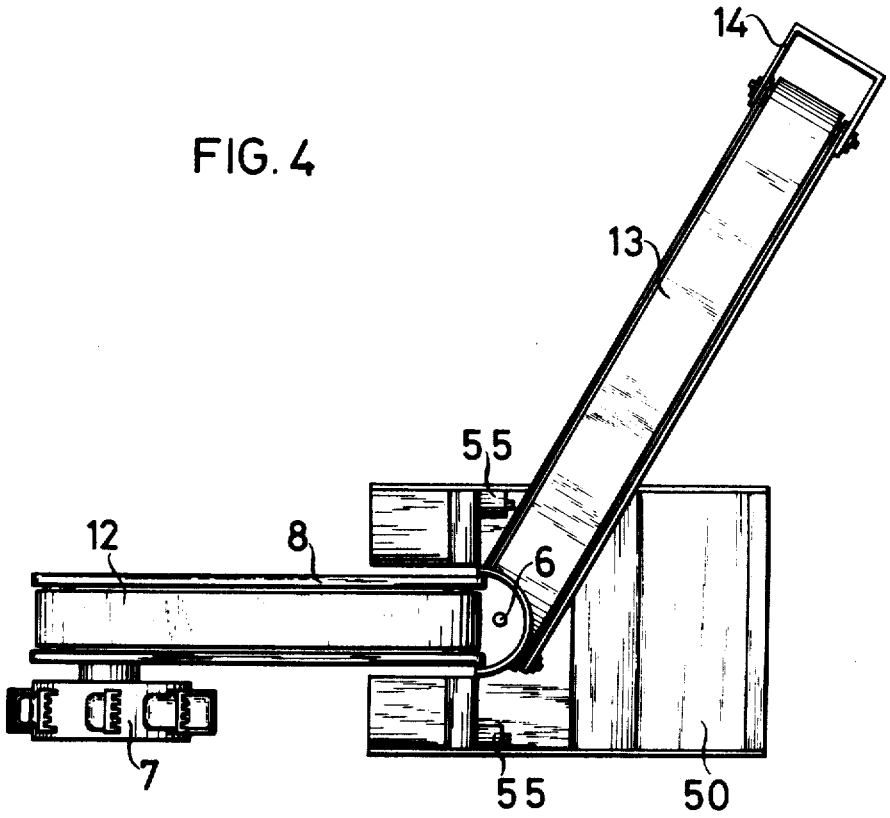
FIG. 4 shows a limit switch arrangement for control of magnet valves.

The control of the magnet valves 53*a* and 53*b* by way of limit switch 55 can be found in FIG. 4.

After a cut has been finished, the bucket wheel dredge must be advanced by the chip depth in working direction. To this end, it is necessary that the operator actuates the control slides 28*a* *a*and 28*b*. The pressure oil conveyed through conduits 26 and 27 will then be separated from the conduits 29*a* and 29*b* and will be brought into communication with the conduits 31*a* –31*d*, depending on the position of the control valves 28*a* and 28*b*. An optimum maneuverability of the bucket wheel dredge will be realized by driving one chain of the track laying means 1 in forward direction and the other chain in the opposite direction. For obtaining the optimum power output when the bucket wheel 7 cuts into the soil and for simultaneously advancing, the pressures prevailing in the conduits 24–27 are added up in the total output controls 32 and 33 that form cumulative output governors, shown by German Pat. No. 1,188,891-Eickmann dated July 14, 1966, so that the speed of the bucket wheel 7 will also be influenced by the advancing resistance.

As will be evident from the above, the arrangement according to the present invention has over heretofore known bucket wheel dredges with change of the speed of the bucket wheel in conformity with the pivot angle and/or the delivery output the advantage of a constant optimum output utilization by simply ascertaining the pressures at the pumps which serve for driving the bucket wheel and the dredge.

U.S. Pat. No. 3,471,949-Cargile, Jr. issued Oct. 14, 1969 shows a device for influencing respectively varying the swing speed dependent upon excavating resistance by means of a loss regulation; such regulation would be known. In contrast, however, with the teaching of the present invention there is noted that there is provided automatic regulation free of losses both automatically as to the speed of the dredge or excavator wheel and also automatically without losses as to the swing speed dependent upon excavating resistance.

With U.S. Pat. No. 3,380,179-Schmidt issued Apr. 30, 1968, the concern, likewise, is with a cutting head excavator or dredge with which the swing speed is influenced dependent upon cutting or excavating resistance. For solution of this object, there is necessary a complex electrical and electronic control circuitry. The concern hereby is with an electric control with hydraulic drive mechanism or apparatus. In contrast, the teaching of the present invention expressly avoids the detour by way of electric control circuitry and utilizes the working pressure directly for control purposes. Thereby there is created a simple and readily serviceable and advantageous system that is infrequently subject to disturbances and disruptions.

U.S. Pat. No. 3,470,635-Langner et al issued Oct. 7, 1969 discloses an arrangement with which there is attained by way of a number of feelers independently of the hardness of the material to be removed (which means from the material characteristics only dependent upon the chip or removing depth to contain a continuous conveying quantity).

With U.S. Pat. No. 3,189,103-Attebo et al issued June 15, 1965 there are to be controlled two movements dependent upon a working resistance whereby the interrelationship of both circuits can be accomplished by way of a pressure cut-off valve which achieves the forward stroke movement upon attaining a predetermined maximum pressure. Basically, the concern is with two operating movements controlled independently of each other, which only become joined in this one previously set point not until after attaining the maximum pressure, but there cannot be recognized any pertinence of this reference relative to the teaching of the present invention.

Figure 3:
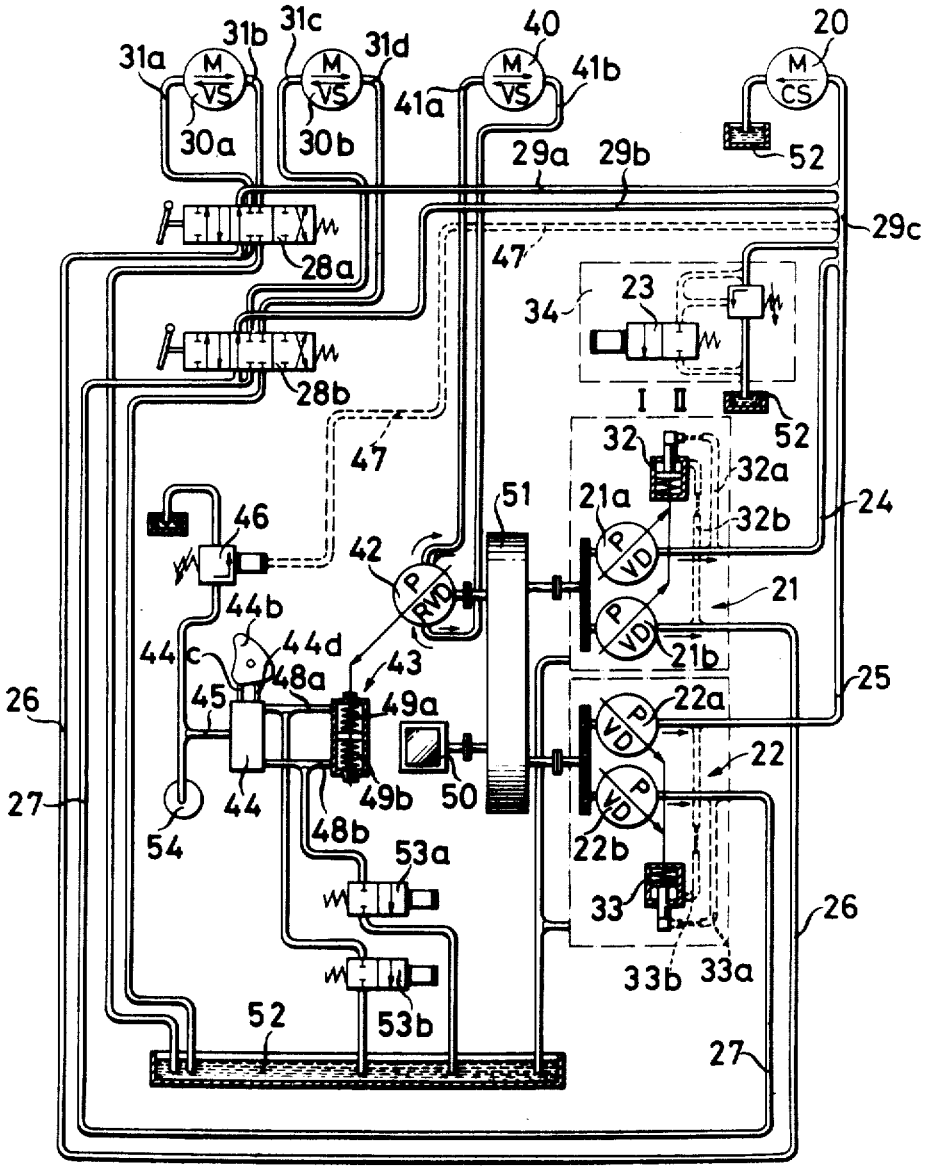
FIG. 3 illustrates a portion of a hydraulic diagram similar to that of FIG. 2 through modified with cam disc means.

The teaching of the present invention involves a hydraulic system concerning a completely operational and functional hydraulic plant providing novel features. The actuation of the regulating valve or control device 44 by way of a cam disc rather than by means of a lever 44*a* has been mentioned previously in this description; FIG. 3 shows the actuation of the regulating valve or control device 44 occurring by way of the cam 44*b*. Normally, the operation of the valve or device 44 occurs by way of an operator and serves to influence the pivot direction and pivot speed. There is, however, conceivable that with predetermined working application of the excavator there should or must be undertaken certain automation as to the pivot procedure. In this case there must be provided a cam embodied to correspond to the desired function; this cam is arranged centrically as to the pivot axis so that during rotation of the upper structure there becomes determined or sensed a different curve or cam point with every angular position. By way of different height of the individual curve points there results accordingly a different actuating path for the control valve or device which leads to different swinging or traversing of the pump and leads accordingly to an angular positioning of the upper structure corresponding to the pivot speed. This construction previously was not set forth so that actually no detailed construction features pertaining thereto should be necessary with respect to the teaching of the present invention. The features of the present invention are applicable independently of such detailed construction features.

However, the foregoing clarification should aid in recognizing the relation to other components of the invention and mode of operation with respect to the cam. There is to be understood, however, that in accordance with the foregoing description the concern involves not only a manually operable control for varying the delivery and the delivery direction of the pump, but rather the control or regulation of the conveyed quantity or output of the pump also can occur automatically by means of the cam of which the turning or rotation becomes limited by way of abutments which are installed upon the upper structure. There is to be noted that this involves only an ancillary feature because the object and solution according to the present invention also can be resolved without such a detailed feature being taken into consideration.

The drawings in the present case illustrate parts 32 that should not be mistaken as conduits relative to the pumps 21*a* and 21*b*, but rather in actuality, there are involved linkages for control or regulation of the conveying quantity or output of the pumps. However, for clarification purposes the following additional statements are made and can be taken to belong to the basic knowledge in the field of hydraulic technology as a known precondition. The function of the delivery quantities or output of pumps 21 and 22 can be considered as a function of the summation output control or regulation thereof. The double pump means 21*a* and 21*b* respectively 22*a* and 22*b* consists of two axial piston pumps according to the pivot drum principle and becoming driven or operated in common by way of a drive means. The function of the pressure oil generation is apparent from FIG. 5. The piston path "$h$" and accordingly the conveyed volume become determined per rotation by way of the angle $\alpha$.

Consequently, by way of change of the angle $\alpha$ there can also be changed the conveyed volume since the cylinder drum is pivotally journalled together with the surrounding housing. The angle $\alpha$ can be easily changed from the outside as represented in the constructive illustration of the pump in FIG. 6. Parts of the pump are labeled in the drawings rather than using reference numeral designations therewith.

For the foregoing purpose, the control elements 32 respectively 33 of the present invention must engage against the pivot stud means $1a_1$ and $1b_1$ as shown in FIG. 7. With a double pump with a summation output control the pivot studs $1a_1$ and $1b_1$ of both cylinders are drums mechanically connected with each other by means of a link 2. The control element, in this case a summation output control or regulator engages against this link 2. The control piston is embodied as a stepped piston 4 with surfaces 4*a* and 4b being equal in magnitude or size. The control surface 4*a* is connected by way of a control conduit with the pressure conduit $P_2$ of the pump 1*b* and the control surface 4*b* is connected with the pressure conduit $P_1$ of the pump 1*a*. A control spring 3 presses the pumps 1*a* and 1*b* as to a maximum pivot angle $\alpha$. The same is so embodied that upon attaining the maximum pressure in the conduits $P_1$ and $P_2$ there becomes attained the minimum as to the magnitude of the pivot angle $\alpha$. There becomes utilized accordingly the summation of the pressures in the conduits $P_1$ and $P_2$ as the control or regulating magnitude. If there prevails for example the maximum pressure only in the conduit $P_1$ while in the conduit $P_2$ the pressure is equal to zero, so both pumps become pivoted only into an angle position expressed mathematically as:

$$\frac{\alpha \max - \alpha \min}{2}$$

Figure 2:
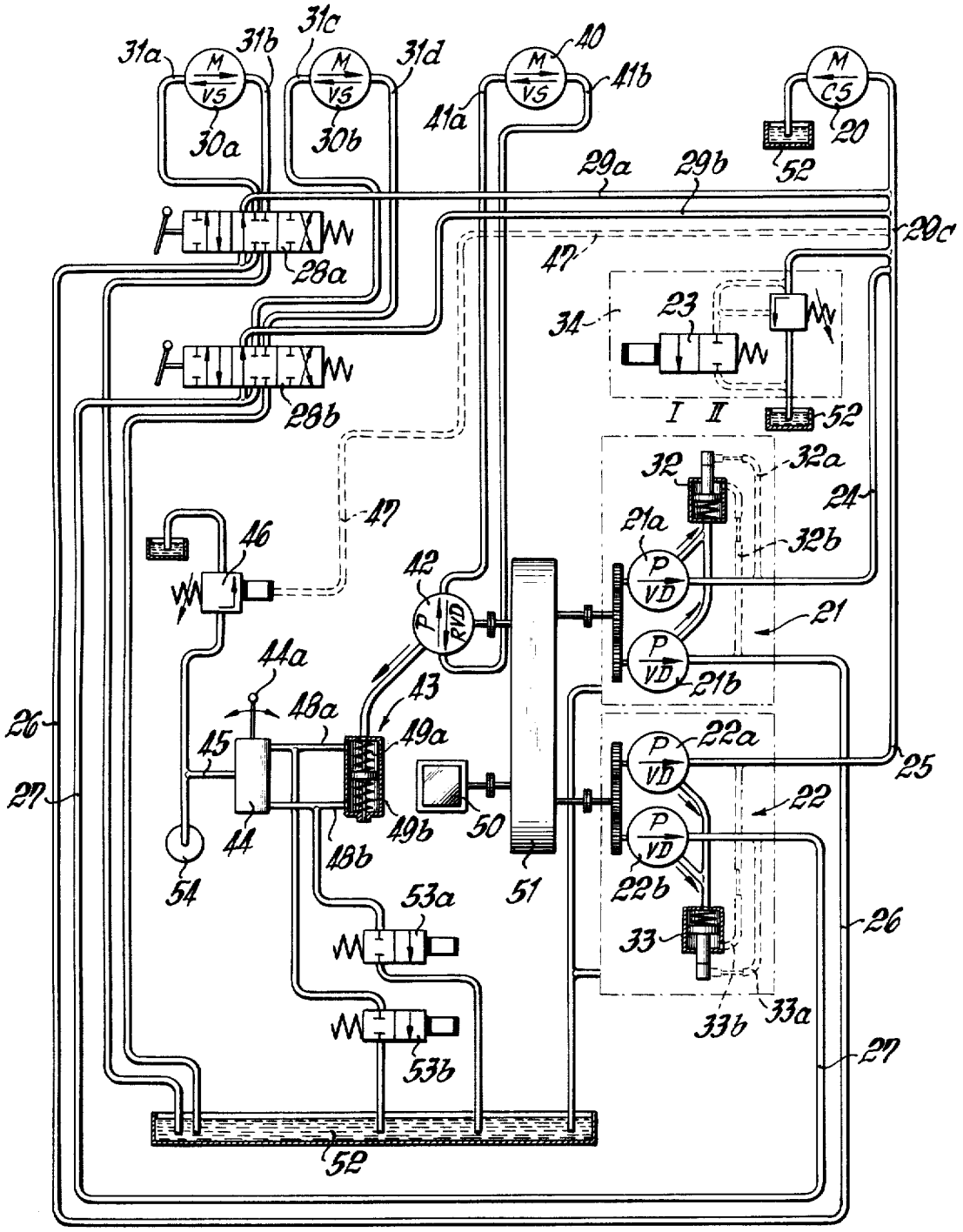
FIG. 2 illustrates the main portion of a hydraulic diagram with the elements of the control according to the invention.

With the pump 42 the concern in any event involves an axial piston pump according to the pivot drum principle in accordance with FIGS. 5 and 6. With the regulator 43 with the springs 49*a* and 49*b* the concern is with a control pressure dependent hydraulic servo-regulator. The valve or control device 44 serves for regulation and control of the control pressure. This valve or control device becomes superimposed by way of the hydraulically regulated pressure control valve 46. The control pressure necessary for control or regulation of the valve or control device 46 becomes determined by way of the conduit 47 out of the pressure conduit 29*c* leading to the scoop or bladed-wheel motor 20. The magnetcontrolled valve means 53*a* and 53*b* serve as emergency switch-off means; if the same become actuated, so the control pressure existing in the chambers pertaining to the springs 49*a* and 49*b* collapses so that the springs bring the pump 42 into the pivot angle $\alpha = 0°$; accordingly there occurs no conveying or output of the pump 42. In FIGS. 2 and 3 there have been illustrated very strongly simplified illustrations or representations of the control elements. In order to provide a better understanding, the following additional statements are made with respect thereto.

FIG. 8 represents a schematic illustration of the configuration of the control valve or device 44 and in FIG. 9 there is illustrated the control characteristic thereof.

FIG. 10 schematically illustrates the cooperation of the elements 44 and 43. The operational sequence thereof can be described as follows:

The pressure means source 54 generates a constant pressure of $p = 50$ bar. This pressure exists in the chamber 105 and before the jets or nozzles 107, 108, 109 and 110 and accordingly also in the chamber 101 and 104. The conduit 45 becomes blocked by way of the valve or control means 46. If the valve or control device 44 is in its neutral position, so the oil flowing through the jets 108 and 109 flows by way of the conduits 44*a* and 44*b* and by way of the valve or control device 44 in a pressureless manner to the tank; the control piston 106 is pressure equalized.

If now the manual lever 44*a* of the valve or control device 44 is pivoted to the right for example, so correspondingly the pressure rises in the conduit 48*a* as to the path of deviation or outward pivoting (see FIG. 9). The control piston 106 becomes shifted toward the left, and hereby the pressure means from the pressure means source 54 can reach into the chamber 49*b* while the chamber 49*a* becomes relieved or discharged with respect to the tank. The pump 42 becomes pivoted out toward the right by way of the adjustment member 111, which means that the pump conveys corresponding oil quantity in the conduit 41*b* in a relationship corresponding to the pivot angle $\alpha$ (see FIG. 5). Simultaneously the return spring 112 becomes stressed so far that the equilibrium, balance or stability prevails with the force exerted in the chamber 103 upon the piston 106 so that the chamber 105 becomes blocked. A further pivoting out of the pump 42 is possible only when the control lever 44*a* becomes pivoted further out. The return of the pump 42 respectively a pivoting out of the pump toward the left occurs in a sensible manner. Upon receiving a command "emergency out", the valves 53*a* and 53*b* shift in such a manner that the chambers 102 and 103 become relieved or discharged to the tank. The pump 42 returns into the null position thereof.

If the pressure existing in the conduit 47 rises above a value set at the valve or control means 46 by means of the spring 113, so the valve 46 reduces existing control pressure in the conduit 45 so that no further pivoting out occurs also upon increasing the control pressure in the conduits 48*a* or 48*b*.

There is to be noted that commercially available parts can be used for the pump means and other components referred to in the foregoing clarification of the description.

It is, of course, to be understood that the present invention is, by no means, limited to the specific showing in the drawings but also comprises any modifications within the scope of the appended claims.

What we claim is:

1. A hydraulically controlled and driven dredge governed directly by working pressure which includes: a bucket wheel, track laying means, a lower structure supported by said track laying means, an upper structure supported by said lower structure and pivotable about a vertical axis relative to said lower structure, a boom pivotable in a vertical plane and supported by said upper structure and supporting said bucket wheel, first hydraulic motor means drivingly connected to said bucket wheel for driving the same, first pump means for delivering actuating fluid to said first hydraulic motor means, actuating fluid conveying first conduit means leading from said first pump means to said first hydraulic motor means, power control means responsive to changes in the digging resistance encountered by said bucket wheel and operatively connected to said first pump means for varying the delivery thereof in conformity with said varying digging resistance of said bucket wheel, second hydraulic motor means operatively connected to said upper structure for pivoting the same about its vertical axis, second pump means arranged in a closed circuit with said second hydraulic motor means for delivering actuating fluid thereto, power output limiting valve means, second conduit means branching off from said first conduit means and connected to said power output limiting valve means, control circuit means including an adjusting unit and manually adjustable control means hydraulically connected to said adjusting unit by said control circuit means, said control circuit means hydraulically communicating with said power output limiting valve means, third hydraulic motor means drivingly connected to said track laying means for driving the same, third hydraulic pump means, third conduit means connecting said third hydraulic pump means to said third hydraulic motor means, additional valve means interposed in said third conduit means, and fourth conduit means connected to said additional valve means and leading to said first hydraulic motor means, said additional valve means being operable selectively to interrupt the supply of actuating fluid from said third pump means to said third hydraulic motor means when said track laying means is not to be operated and to convey the delivery from said third pump means to said first hydraulic motor means through said fourth conduit means.

2. A dredge according to claim 1, which includes cam means operable in conformity with the pivot angle of said bucket wheel for determining the pivoting speed of said boom.

3. A dredge according to claim 1, in which said power control means form cumulative output governors.

4. A dredge according to claim 1, in which said additional valve means are spool valves movable to a neutral position for conveying the delivery of said third pump means to said first motor means, and also are movable to two different positions for moving said track laying means on opposite sides of said dredge selectively in the same direction or in opposite directions with regard to each other.

5. A dredge according to claim 4, which includes preset pressure limiting valve means for returning in a pressureless manner the delivery of said first pump means.

6. A dredge according to claim 1, which includes two-way means associated with said control circuit means and also includes a fluid reservoir, said control circuit means being connectable to said fluid reservoir by means of said two-way valve means.

* * * * *